US005792174A

United States Patent [19]

Ioan

[11] Patent Number: 5,792,174

[45] Date of Patent: Aug. 11, 1998

[54] NATURAL HEADACHE RELIEVER USING ACUPRESSURE POINTS

[76] Inventor: Radu Ioan, 1508 Centinela Av. Ap. 8, Los Angeles, Calif. 90025

[21] Appl. No.: 820,853

[22] Filed: Mar. 20, 1997

[51] Int. Cl.[6] ..... A61H 7/00

[52] U.S. Cl. ..... 606/201; 606/204; 606/204.15; 128/97.1

[58] Field of Search ..... 601/9, 11, 12, 601/134, 95, 135; 606/204, 204.15, 201, 202, 203; 128/97.1, 105.1, 104.1

[56] References Cited

U.S. PATENT DOCUMENTS

| | | | |
|---|---|---|---|
| 763,814 | 6/1904 | Turner, Jr. | 128/97.1 |
| 841,714 | 1/1907 | Peters | 128/97.1 |
| 937,596 | 10/1909 | Gray et al. | 128/97.1 |
| 3,159,160 | 12/1964 | Ullom | 128/97.1 |
| 3,716,048 | 2/1973 | Alonso | 601/95 |
| 4,469,092 | 9/1984 | Marshall et al. | 601/70 |
| 4,944,289 | 7/1990 | Matthews | 601/134 |
| 5,228,431 | 7/1993 | Giarretto | 601/9 |
| 5,245,989 | 9/1993 | Simon | 601/138 |

*Primary Examiner*—Michael Powell Buiz
*Assistant Examiner*—David O. Reip

[57] ABSTRACT

A natural headache reliever using acupressure points on the scalp and upper posterior neck is disclosed. A cap-like device having an outer membrane (1) and an inner membrane (2) will be placed comfortably on the head of the wearer. The two membranes meet and are attached at their margins, thus forming an inner potential space (4) between the membranes. The inner membrane, that which will be closest to the scalp of the wearer, will contain a plurality of immobile protrusions (5) at a distance of between 10 and 20 millimeters apart. Direct pressure will be applied by the protrusions on different acupressure points on the scalp and upper posterior neck. A pump (3) will be used to create the pressure by introducing air into the potential space (4) between the inner and outer membranes. The wearer controls the duration and amount of pressure, thereby ensuring his or her comfort while alleviating the head pain.

3 Claims, 1 Drawing Sheet

NATURAL HEADACHE RELIEVER USING ACUPRESSURE POINTS

BACKGROUND—FIELD OF INVENTION

This invention concerns a novel drug-free relief of various headaches by stimulating acupressure points on the scalp and upper posterior neck.

BACKGROUND—PRIOR ART

Headaches are a very common disorder affecting millions of people worldwide. A common cause of headaches, concluded by present day scientific research, is dilatation of the blood vessels of the head and scalp. Another common source of headaches is tension of the muscles of the head and neck. There are numerous medications on the market used to treat headaches. While medications are often effective, it is not without risk due to toxic side effects and/or the possibility of adverse reaction. Many patients therefore, opt to using drug-free types of treatments.

Many headache sufferers often seek relief by applying finger pressure over the areas of most severe pain. This type of treatment is limited to a small number of pressure points that can be stimulated simultaneously. It is also limited in the potential pressure time due to the fingers becoming fatigued.

Some individuals tie pieces of clothing around the head to apply pressure. This is not very practical because of the impossibility of applying uniform pressure all around the head.

Others find acupuncture and acupressure therapies safe and cost-effective alternatives. Acupuncture use for relief of headaches has been used successfully for many years. Acupuncture is the method of employing insertion of needles into the skin at exact, spatially defined points in order to treat specific disorders. Akin to acupuncture is acupressure, the application of pressure at the traditional acupuncture points. Acupressure is frequently employed in lieu of acupuncture. Both of these treatment techniques are widely accepted by the health care community and the general public as valid forms of treatment for alleviating headaches. One problem, which has been noted with both acupuncture and acupressure, is that a skilled, licensed practitioner is required to administer the treatment.

Various devices, as cited below, have been developed in order to help this problem.

U.S. Pat. No. 763,814, issued to Turner (1904), describes an appliance with a piece of metal placed across the crown of the head. This does not provide any generalized pressure. There are two pieces of wood attached to the ends of the metal part which deliver pressure over the temple only. There is no mechanism for adjusting the amount of pressure applied. The entire device is cumbersome and it only provides pressure on a limited area.

U.S. Pat. No. 841,714, issued to Peters (1907), describes a "head-truss". It consists of two metal Pieces set at 90 degrees with pads attached at the ends of each member and one pad at the crossing point of the two members on top of the head. The truss basically has the same design as Turner's except for the additional pads. It can apply pressure only in a localized fashion. There are no provisions for adjusting the amount of pressure applied.

U.S. Pat. No. 937,596, issued to Gray and Hitchcock (1909), is also similar in its approach and uses metal parts with pads. Again, there is no adequate provision for applying specific pressure where or in the amount needed.

U.S. Pat No. 3,716,048, issued to Figueras, Jr. (1971), describes a head messaging machine. This motorized machine allows for a massage of the scalp which is very different from the acupressure technique. It is limited in use due to its cumbersome nature, weight, and cost. Furthermore, the complexity of the machine may require a potentially high repair expense.

U.S. Pat. No. 4,944,289, issued to Matthews (1990), describes a headband that is limited to inducing pressure on a maximum of six points. The top of the head and the upper part of the posterior neck, where there are numerous acupressure points, remain untreated. Also, the amount of pressure is not very easily or efficiently controlled.

U.S. Pat. No. 5,228,431, issued to Giarretto (1990), is similar in approach to U.S. Pat. No. 3,716,048 issued to Figueras, Jr. Its main purpose is suggested to be a treatment for alopecia, and secondly for headaches. This devised also employs a massaging effect. It uses a vacuum to introduce ambient and negative air pressure which massage the scalp through soft or semi-soft gently moveable extrusions. Massaging the scalp gently with soft extrusions does not stimulate specific acupressure points. The cumbersome nature of this whole device and its relatively high weight will make it difficult to transport. There is also a higher potential for repair costs due to the complexity of the device.

In conclusion, all of these earlier devices suffer from a number of shortcomings. These include the cumbersome nature of the apparatus, lack of adequate provisions for application of sufficient pressure, discomfort to the patient, and a high repair cost potential. Moreover, they do not use the principle of acupressure.

OBJECTS AND ADVANTAGES

The current invention employs a drug-free treatment for alleviating headaches of different types by using the well established method of acupressure. Acupressure points on the scalp and upper posterior neck will be stimulated. The amount of pressure will be very easily and effectively monitored by the wearer. The Natural Headache Reliever will be easily manufactured due to its simple mechanism and design. It will be inexpensive, very durable and comfortable to use. Other objects and advantages are:

1) Applying variable amounts of pressure on certain points will induce a beneficial pumping action on the circulatory system by stimulating the involved muscles and the circulatory vessels that pass through them. This improves blood circulation efficiency by favoring the exchange of nutrients at the cellular level.
2) Stimulation of the lymphatic system activates the passage of lymph into the bloodstream, thus promoting improved detoxification of the area.
3) In the numerous muscles of the head and upper posterior neck, where pressure will be applied, relief of tension will be experienced by the wearer.
4) Applying pressure on certain points of the scalp and upper posterior neck will also have an effect on many sensory and motor nerves found within the skin covered by the Natural Headache Reliever. This can be very effective in balancing the nervous system and restoring homeostasis. The skin and muscles contain many nerve endings and connections, and the soothing, balancing, healing touch of pressure will be relayed by them to every part of the head and neck.
5) Overall, the Natural Headache Reliever will activate the body's own healing process without the use and interference (many times with negative side effects) of synthetic drugs. Stimulation of the inherent regenerative and cleansing capabilities of the human body will ultimately result in the relief of head pains.

Further objects and advantages of my invention will become apparent from a consideration of the drawings and ensuing description.

DESCRIPTION OF INVENTION

Figure 1:
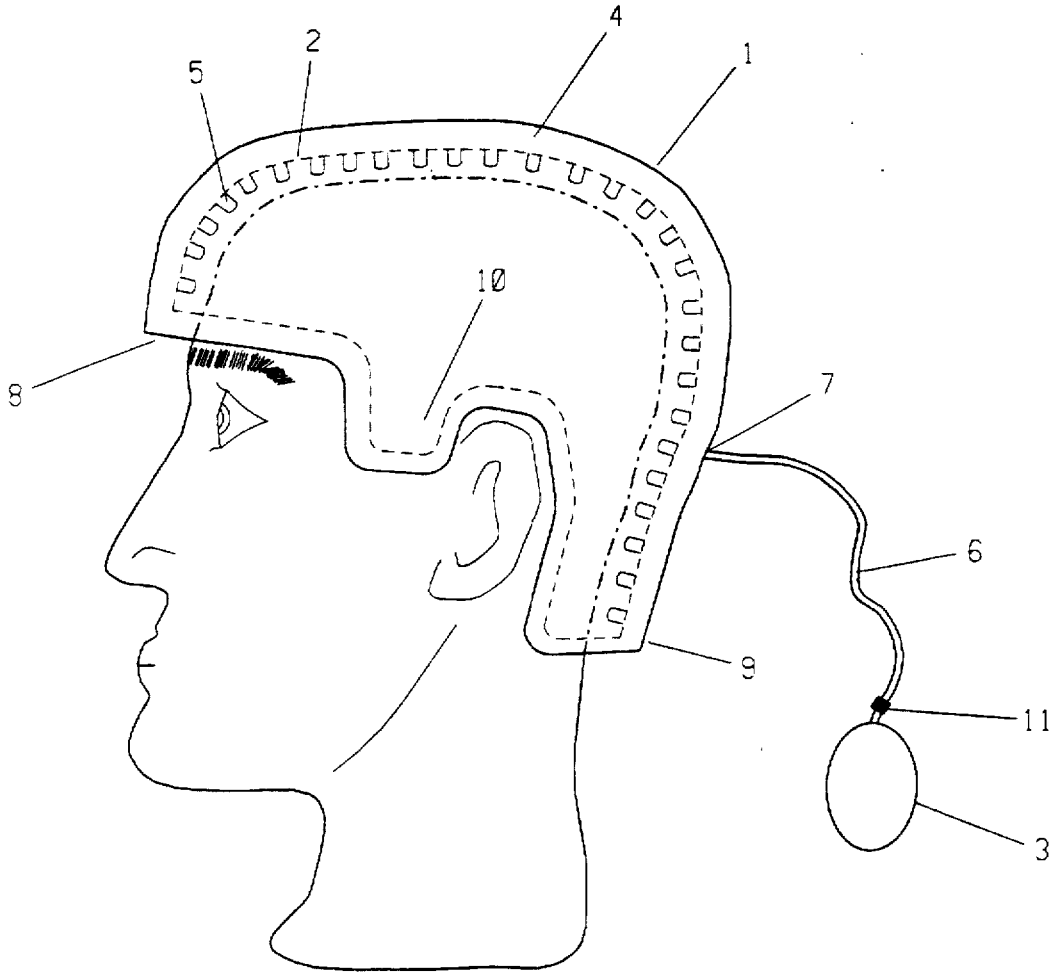
FIG. 1 depicts the cross-section, side view of the Natural Headache Reliever using acupressure points.

This invention is based on the principle of acupressure. A cap-like apparatus (FIG. 1) will be placed comfortably on the head of the wearer. It will cover the entire scalp of the wearer from the supraoptic margins (8), anteriorly, to a few centimeters below the base of the occiput (9), posteriorly. It would also cover the temporal region (10). The apparatus will consist of two membranes: an outer membrane (1) and in inner membrane (2). The membranes will meet and be attached at their margins, thus forming an inner potential space (4) between the membranes. The membranes will be made of a material which has the ability to stretch in such a way as to allow for adaptation to different head sizes. The inner membrane, that which will be closest to the wearer's scalp, will have a plurality of immobile protrusions (5) attached to it. The protrusions will come in contact with the wearer's scalp and posterior upper neck. The protrusions will be made of a hard material, either plastic or rubber. The protrusions will be attached to the inner membrane at their base. The base of the protrusions will be circular in shape, with a diameter of between 10 and 15 millimeters. The height of the protrusions will also be between 10 and 15 millimeters. The part of the protrusions which will come in contact with the wearer's scalp will be rounded off slightly to ensure comfort. The protrusions will cover the entire surface of the inner membrane with a space of 10 to 20 millimeters between the protrusions.

A pump (3) will introduce air into the potential space through a tube (6) and an opening in the outer membrane (7). The flow of air into or out of the potential space will be controlled by twisting the knob (11) clockwise or counter clockwise.

OPERATION OF INVENTION

The Natural Headache Reliever will be placed on the wearer's head conformably. By using the pump (3), the wearer can introduce air inside the potential space (4). This will cause the protrusions (5) to apply pressure directly on points of the scalp and upper posterior neck. When the wearer feels enough pressure, he/she can maintain that pressure for approximately seven seconds. Thereafter, the pressure can be relieved by twisting the knob (11) allowing the air to be released. This process can be repeated as many times as it is needed to relieve the head pain. This type of pressure treatment has been successfully used for many years as part of acupressure and Shiatsu therapies.

CONCLUSIONS, RAMIFICATIONS, AND SCOPE

The reader will see that the Natural Headache Reliever using acupressure points is an invention of great use for millions of headache sufferers. Its uniqueness in the field and its great potential marketability is obvious. The effectiveness of acupressure has been proven for many years. This device allows the wearer to control and administer this type of therapy at any time needed. It is safe and easy to apply. It is a lightweight, highly efficient, yet economical device that can be very easily used by persons of almost any age. While the above description contains many specificities, they should not be construed as limitations on the scope of the invention, but rather as an exemplification of one preferred embodied thereof. Many other variations are possible.

Accordingly, the scope of the invention should be determined not by the embodiment illustrated, but by the appended claims and their legal equivalents.

That which is claimed is:

1. A natural headache reliever acupressure device comprising:

a stretchable cap-shaped apparatus having an outer stretchable membrane and an inner stretchable membrane for comfortably covering a head of a wearer, said inner and outer membranes being attached along outer edges to define an enclosed space between said membranes:

a pump for introducing air into said enclosed space;

a knob associated with said pump for selectively controlling the flow of air into and out of the enclosed space; and a plurality of fixed protrusions attached to said inner membrane, whereby when said pump introduces air into said enclosed space, said enclosed space is pressurized, expanding said membranes and pressing said fixed protrusions directly on points of the wearer's scalp and upper posterior neck.

2. A natural headache reliever acupressure device according to claim 1 wherein said pump is a hand pump and is configured to be controlled by the wearer.

3. A natural headache reliever acupressure device according to claim 1 wherein said device is configured to apply pressure of an amount and duration controlled by the wearer, whereby head pains can efficiently be relieved.

* * * * *